US011097753B2

(12) United States Patent
Fel et al.

(10) Patent No.: US 11,097,753 B2
(45) Date of Patent: Aug. 24, 2021

(54) MODULAR PERSONAL PROTECTION DEVICE UNDER THE VEHICLE

(71) Applicant: Bombardier Transportation GmbH, Berlin (DE)

(72) Inventors: Landri Fel, Vienna (AT); Gerald Newesely, Vienna (AT); Herbert Tuczai, Vienna (AT)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 16/700,345

(22) Filed: Dec. 2, 2019

(65) Prior Publication Data

US 2020/0198668 A1 Jun. 25, 2020

(30) Foreign Application Priority Data

Dec. 20, 2018 (DE) ..... 10 2018 133 177.0

(51) Int. Cl.
*B61F 19/08* (2006.01)
*B61F 19/04* (2006.01)

(52) U.S. Cl.
CPC ..... *B61F 19/08* (2013.01); *B61F 19/04* (2013.01)

(58) Field of Classification Search
CPC ..... B61F 19/00; B61F 19/04; B61F 19/06; B61F 19/08; B60R 2021/009
See application file for complete search history.

(56) References Cited

U.S. PATENT DOCUMENTS 6,031,449 A * 2/2000 Laporte ..... G01S 13/86 340/436
6,474,489 B2 * 11/2002 Payne ..... B61F 19/06 105/392.5
6,619,491 B2 * 9/2003 Payne ..... B61F 19/06 105/392.5
6,814,246 B2 * 11/2004 Payne ..... B61F 19/06 105/392.5
6,923,483 B2 * 8/2005 Curry ..... B60R 19/205 180/274
8,646,391 B2 * 2/2014 Schmidt ..... B61D 17/02 105/8.1
9,150,225 B2 * 10/2015 Somensi ..... B61F 19/06
2003/0047370 A1 * 3/2003 Gibbs ..... B61F 19/04 180/271

(Continued)

FOREIGN PATENT DOCUMENTS

DE 121019 D 4/1900
DE 148622 D 9/1902

(Continued)

*Primary Examiner* — Zachary L Kuhfuss
(74) *Attorney, Agent, or Firm* — The Webb Law Firm

(57) ABSTRACT

An airbag module and a rail vehicle with an airbag module are described herein. The airbag module includes a support flap, which is pivotably mounted on its rear end, such that the airbag module is convertable from a closed state into an open state by pivoting the support flap. The airbag module further includes an airbag, which is folded in the closed state of the airbag module and unfolded in the open state of the airbag module, so that the unfolded airbag and the support flap together form an impact protection for a person on the track. Furthermore, a rail vehicle with one or a plurality of airbag modules is described.

14 Claims, 11 Drawing Sheets

(56) References Cited

U.S. PATENT DOCUMENTS

| | | | | |
|---|---|---|---|---|
| 2020/0198668 | A1* | 6/2020 | Fel | B61F 19/08 |
| 2020/0198669 | A1* | 6/2020 | Fel | B61F 19/08 |

FOREIGN PATENT DOCUMENTS

| | | | |
|---|---|---|---|
| DE | 166218 | D | 2/1904 |
| DE | 255173 | D | 6/1912 |
| DE | 2910481 | A1 | 9/1979 |
| DE | 102011114298 | A1 | 3/2013 |
| DE | 102013211273 | A1 | 12/2014 |
| DE | 102017001332 | A1 | 7/2017 |
| EP | 2995508 | A1 | 3/2016 |
| GB | 190207793 | A1 | 5/1903 |
| JP | 2003341513 | A | 12/2003 |
| JP | 2006273139 | A | 10/2006 |
| JP | 2016007951 | A | 1/2016 |
| JP | 6004273 | B2 | 10/2016 |
| KR | 1020110071693 | A | 6/2011 |
| WO | 2014140074 | A1 | 9/2014 |
| WO | 2018019540 | A1 | 2/2018 |

* cited by examiner

MODULAR PERSONAL PROTECTION DEVICE UNDER THE VEHICLE

CROSS-REFERENCE TO RELATED APPLICATION

This application claims priority to German Patent Application No. 10 2018 133 177.0 filed Dec. 20, 2018, the disclosure of which is hereby incorporated by reference in its entirety.

BACKGROUND OF THE INVENTION

Field of the Invention

The invention relates to a modular personal protection device for fixing on the underside of a rail vehicle.

Description of the Related Art

Accidents, in which rail vehicles collide with persons (passers-by), usually end fatally for the person. In many cases, the passer-by ends up under the rail vehicle after the collision, where they suffer serious injuries, as the vehicle underside of a rail vehicle often represents a high risk of injury due to sharp and unprotected edges. Airbags are principally known as protective measures due to multiple uses in the automobile industry; however, they have rarely been used up to now in the rail vehicle industry, even though multiple published documents exist regarding the application of personal protection measures using airbags in use for rail vehicles.

Most ideas draw on two principles. On the one hand, protecting persons who have been partially or not yet run over from additional collisions with structures under the vehicle using protective devices, and/or on the other hand, preventing a person who has been run over from moving farther into the structures located toward the rear in the direction of travel, in particular, the wheels of the train.

Thus, documents DE 148622 C, DE 166218 C, DE 255173 C, EP 2 995 508 A1 and WO 2018/019540 A1 are known, which disclose soft structures that open or stretch out, for example, nets, planes, or airbags, on the vehicle front. These soft structures are designed to prevent the running over of passers-by in the direct area of the vehicle front, i.e., the effective protective area is the area at the vehicle front of the rail vehicle. The soft structures are thereby guided by a more robust structure.

On the other hand, documents GB 1902 07793 A, DE 121019 C and WO 2014/140074 A1 are known, which disclose devices that are unfoldable or extendable from below. This are arranged underneath the vehicle bottom and behind the vehicle front respectively, so that the devices prevent the person who has been run over from arriving or reaching structures located farther back.

DE 148622 C thus describes a protective device on tram cars. The protective device has a catch net as a protective mechanism, which is guided in a more robust structure, wherein the catch net may be unfolded upon impact of the tram car. The protective device is thereby arranged in front of the tram car.

A tram protective device is known from DE 166218 C, which is triggered by an obstacle and then springs forward in order to be able to pick up the obstacle by means of a catch device.

DE 255173 C describes a protective device for tram cars, which has containers, filled with compressed air under the platform and moveable about articulations, which are respectively connected to an elastic sack (protective cushion). Upon the impact of an obstacle against the elastic sacks, the affected container is moved backwards, by which means the compressed air flows into the respective elastic sack.

A vehicle is known from EP 2 995 508 A1 whose front section has a protective device. The protective device comprises a bumper arranged on the front side of the vehicle, wherein, in the case of an impact or the presence of an obstacle, a flap of the bumper opens toward the under part of the vehicle, wherein the flap has a protective surface. Furthermore, the protective device has a cover arranged on the front side of the vehicle, which may transfer from a closed into an open position, wherein the cover has first means for absorbing impact energy which are capable of unfolding due to inflation.

A personal protection device for a vehicle with a front fairing arranged in front of elements causing risk of injury is described in WO 2018/019540 A1. The front fairing has a two-part frame and a flexible tarpaulin, wherein a lower frame part is articulately connected to an upper frame part.

GB 1902 07793 A shows a cradle, arranged below a rail vehicle, with a trigger mechanism mounted upstream, which can accommodate a person who has been run over.

DE 121019 C describes a protective device, arranged on the underside of a tram car, and having a protective wall, which extends across the width of the track and which, after triggering, falls on the track and thereby lifts the front end of the rail vehicle.

A safety device is known from WO 2014/140074 A1 for protecting persons, which is arranged underneath the vehicle frame and has two functional elements. The second functional element is fixed on the first functional element and corresponds to a braking device, which may have an airbag. The first functional element corresponds to a deflector device, with which it may be prevented that a person, already partially run over, moves farther under the vehicle in the direction of the wheels.

Protective devices arranged in front of the rail vehicle and having an airbag have the disadvantage that the vehicle front is very hard. Thus, a "trampoline" effect may occur, in which a person bounces off, even in a somewhat muted way, and may thus suffer additional injuries.

Airbags underneath the rail vehicle may tear if they contact the track over a longer time period. For example, the time period between initiating a braking process of the rail vehicle and a stopping of the rail vehicle may already be sufficient for seriously damaging an airbag.

SUMMARY OF THE INVENTION

It is therefore the object of the present invention to provide a protective device, in particular an airbag module for a rail vehicle and a rail vehicle which enables improved safety for persons.

According to one embodiment, an airbag module is provided for fixing on the underside of a rail vehicle, between the rail vehicle and the track. The airbag module includes a bracket for fixing the airbag module on the underside of the rail vehicle. The airbag module additionally includes a support flap with a front end and a rear end, which is pivotably mounted at its rear end by means of a pivot bearing, wherein, by pivoting the support flap, the airbag module is transferable or convertible from a closed state into an open state and the front end of the support flap thereby moves toward the track. Furthermore, the airbag module includes a guide element arranged at the front end of the support flap for contacting the track in the open state of the airbag module, and an airbag fixed on the support flap and on the bracket, said airbag being folded in the closed state of the airbag module and unfolded in the open state of the airbag module, and in its unfolded state, it projects past the front end of the support flap so that the unfolded airbag and the support flap together form an impact protection for a person on the track.

The track includes the entire ground underneath the rail vehicle, thus both the rails and also the substrate next to and between the rails.

The airbag is unfolded in the open state of the airbag module, and is thereby preferably filled with gas, by which means the airbag functions as an impact protection for a person on the track. In case the airbag module is in the open state, and, the airbag is not filled, but instead is partially or completely flaccid, for example due to damage caused by a sharp object on the track, the cover of the airbag additionally functions as a safety protection for a person, i.e. the airbag acts as a catch net. This is facilitated in that the airbag is fixed at a plurality of positions, in particular at the support flap and the bracket. After the collision with a person, the airbag may thus not move farther backward and "slip out" of the collision area with the person. The airbag, which is preferably fixed at a plurality of positions, spans the opening of the airbag module that faces forward. This opening is formed between the bracket and the support flap pivoted downward toward the track. The collision area, i.e. the area in which a person, who has been run over, is safely held by the airbag module, therefore remains in front of or in the area of the airbag module, and therefore in front of areas lying farther behind in the direction of travel.

The support flap, held at its rear end by means of the pivot bearing, is pivoted downward toward the track in the direction of travel in the open state of the airbag module and therefore is inclined upward toward the rear. The support flap therefore forms a support surface for the airbag, which lies behind the airbag in the direction of travel. The airbag is therefore prevented from slipping away "to the rear" by the support flap and therefore may, in particular in the gas-filled state, catch a person and, in conjunction with the support flap, prevent the person from moving farther under the traveling rail vehicle. In particular, when the airbag module is arranged in front of the front wheels in the direction of travel, the contact between a person and the wheels may be safely prevented.

In one embodiment, the airbag is fixed on the bracket and on the support flap in such a way that the attachments lie as far back as possible relative to the front end of the gas-filled end of the airbag, and thus are removed from a possible collision zone with a person.

Due to an attachment of the airbag at the support flap and at the bracket, a support of the airbag toward a rear end of the airbag module is provided, for example, along a direction of travel of the rail vehicle. In the open state of the airbag module, wherein the airbag is unfolded, a "slipping through", moving past, or moving farther toward structures located farther back is prevented for a person, who has been run over, by this means. In the case that the airbag module is in the open state, yet the airbag is not filled, but instead is partially or completely flaccid, a "slipping through", moving past, or moving farther toward structures located farther back is prevented for a person who has been run over.

In one embodiment, the airbag is fixed on the bracket by means of at least one first attachment and on the support flap by means of at least one second attachment.

According to one embodiment, the airbag module may contact the track in the open state, i.e. the support flap pivoted downward may directly or indirectly contact the track. By this means, no gap, or only a small gap remains between the track and the airbag module, whereby a largest possible protection area is formed for a person on the track. Due to the support flap being pivoted essentially completely downward, the entire space between the vehicle underside and the track is used for spreading out the airbag and catching a person involved in an accident.

Since the airbag offers protection to a person in the open state of the airbag module, both if the unfolded airbag is filled with gas and also if the unfolded airbag is only partially filled or is completely flaccid, the airbag module offers protection to a person, not only at the time of the collision, but also over a significantly longer time period, for example, until the rail vehicle has come to a halt.

According to one embodiment, the guide element may contact the track in the open state of the airbag module. Typically, only the guide element contacts the track and holds the front end of the support flap at a certain distance from the track. By this means, damage to the support flap is prevented, for example.

The guide element arranged on the front end of the support flap functions to guide the support flap and the airbag over obstacles on the track in the presence of said respective obstacles. The guide element typically projects past the front end of the support flap, and, when the rail vehicle is moving in the direction of travel, therefore enters into contact with an obstacle before the obstacle might come into contact with the support flap. Due to a suitable configuration of the guide element, it may slide or roll over the obstacle during continued movement of the rail vehicle, and thus also lift the front end of the support flap toward the bracket, i.e., in a vertical direction. An impact of the stable and rather rigid support flap on the obstacle may thus be prevented. The opening angle $\alpha$ between the bracket and the support flap is thus reduced somewhat. Without the provision of a guide element, the front end of the support flap may collide with a potential obstacle and possibly be damaged.

According to one embodiment, the guide element is designed as elastic, particularly in the vertical direction, so that it may give way and yield upwards upon striking the obstacle. By this means, it is ensured that the impact energy acting on the guide element, and thus also on the support flap, does not lead to damage, in particular to the support flap.

In one embodiment, the guide element may be designed in the shape of a sliding ski, which is suitable for guiding the support flap and the airbag over a potential obstacle. The sliding ski may thereby in particular have a front end, which is curved or angled upwards. If the track is smooth, then a front area, in which for example the curve is formed, of the sliding ski contacts the track; however, not with its front-most tip. The front-most tip is, for example, curved or angled upwards. During movement of the rail vehicle in the direction of travel, the area, which for example is curved or angled upwards, contacts the obstacle at the underside of said area. Due to the shape extending upward, this area may easily slide over the obstacle, wherein an elastic configuration of the sliding ski promotes this sliding even more.

In another embodiment, the guide element may comprise at least one wheel, wherein the wheel is suited for rolling on the track and may function to guide the support flap and the airbag over a potential obstacle. The guide element is thus designed so that risk of injury to persons is a low as possible. The wheel is suitable for mounting on the front end of the support flap. During movement of the rail vehicle in the direction of travel, the wheel rolls on the track. In this case, as also in the case of the sliding ski, the support flap does not necessarily contact the track. If the wheel contacts an obstacle, it may roll over the obstacle and simultaneously thereby lift the support flap.

The airbag module is suitable for different distances between the underside of the rail vehicle and the track, as the support flap is pivotably mounted at its rear end by means of a pivot bearing. Due to the pivotably-mounted support flap, the airbag module is advantageously suited in the open state of adapting itself to differing distances between the underside of the rail vehicle and the track, for example, during travel. The airbag module is configured to adapt the opening angle $\alpha$ between the bracket and the support flap at a change in the distance between the underside of the rail vehicle and the track. In other words, the airbag module is configured to adapt a height of the airbag module in the open state. The height of the airbag module is defined as the extension of the airbag module perpendicular to an upper side of the bracket, wherein the upper side of the airbag module functions for fixing to the rail vehicle. As the airbag module may adapt to changing distances between the underside of the rail vehicle and the track, a variability with respect to a composition of the track and/or the substrate is achieved, wherein the airbag module is particularly suited for tracks with closed spaces between the rails, and also for the presence of railway sleepers, where the substrate between the rails may be lower than a rail upper edge.

According to one embodiment, the support flap is essentially parallel to the bracket in the closed state of the airbag module and/or the support flap has an angle (opening angle) a from 30° to 80° with the bracket.

According to another embodiment, the airbag module has a height of at most 80 mm in its closed state. Due to the small dimension and a small mass of the airbag module, the expense for the attachment to the underside of the rail vehicle is significantly reduced with respect to the protective devices known from the prior art. A length and a width of the airbag module may be flexibly determined based on the technical properties of the rail vehicle or the composition of the track. The length of the airbag module is the extension from a front end of the airbag module to the rear end of the airbag module, while the width of the airbag module is the extension of the airbag module perpendicular to the height and to the length.

According to one embodiment, the support flap is pivotably mounted at its rear end on the bracket by means of the pivot bearing. The bracket is therefore connected to the rear end of the support flap via the pivot bearing. Thus, a compact design of the airbag module is facilitated. Additionally, the airbag module may be easily fixed on the underside of the rail vehicle, as the bracket supports the entire airbag module.

According to one embodiment, the bracket includes a storage unit, open toward the support flap, which is closed by the support flap in the closed state of the airbag module. The storage unit, together with the support flap, forms a receptacle into which the airbag is inserted. The receptacle functions for protecting the folded airbag from environmental factors in the closed state of the airbag module.

The support flap may include a frame, with the pivot bearing arranged at the rear end thereof, and a cover plate. The frame provides sufficient stability to the support flap, whereas the cover plate as a flat object functions on the one hand as a support surface for the airbag in the open state of the airbag module and on the other hand as a closure cover for the storage unit in the closed state of the airbag module. The cover plate protects the folded airbag from environmental factors in the closed state of the airbag module and supports the airbag after it is unfolded.

In one embodiment, the airbag module includes a gas pressure device for sudden filling of the airbag during opening of the airbag module. The gas pressure device may be connected to the bracket and fixed on the same.

According to one embodiment, the support flap is fixed in the area of its front end via a releasable locking means in the closed state of the airbag module. The locking means is releasable for releasing the support flap and for converting (or transferring) the airbag module into the open state. According to one embodiment, the locking means may be configured to trigger the sudden filling of the airbag by the gas pressure device. In particular, the releasable locking means may be configured in such a way to release the support flap within at most 20 ms.

When the support flap has been released by the locking means, the support flap may be transferred or converted into the open state due to its own dead weight. For example, the airbag module may additionally have a spring device. The spring device may be tensioned when the support flap is fixed, wherein upon release of the support flap by the locking means, the spring device may suddenly pivot the support flap to open the airbag module. Due to the presence of the spring device, the time duration required to transfer or convert from the closed state into the open state may be advantageously substantially reduced.

The airbag module is suitable for installing or attaching on a plurality of different rail vehicles. In particular, the airbag module is suitable for retroactive installation or attachment on a plurality of already-existing rail vehicles, even in the case of very different rail vehicle geometry.

The support flap may thus satisfy a plurality of functions, in particular: a) the support flap may function as protection for the folded airbag in the closed state of the airbag module; b) the support flap functions for fixing the airbag; c) in the open state, the support flap functions to support the airbag in the direction of the rear end of the airbag module. The support flap corresponds to a "support structure" in functions a) and b) and functions as a "retaining device" in function c).

According to one embodiment, a rail vehicle is provided including an airbag module according to any of the preceding embodiments, wherein the airbag module is fixed on the underside of the rail vehicle between the rail vehicle and the track.

According to one embodiment, the airbag module is fixed on the rail vehicle such that in the closed position, the airbag module does not project past the front end and/or the sides of the rail vehicle. For example, in the closed position, the airbag module does not project past the front end nor past the sides of the rail vehicle. By this means, a risk of injury to persons (passers-by) at the airbag module is reduced, in particular in the case where a collision occurs between a person and the rail vehicle.

The rail vehicle may include a plurality of airbag modules. Advantageously, each airbag module may be fixed individually and independently from other airbag modules on the rail vehicle. In particular, the airbag modules do not require any mutual structures, for example, a mutual bracket or support structure. By this means, the workload is significantly reduced in the case of maintenance and/or an installation, conversion, or removal of the airbag module, in particular with respect to rail vehicles, which include a plurality of safety devices that comprise a mutual bracket or support structure.

As the airbag module may be designed as an independent module, a large variability exists with respect to the number of airbag modules desired for the rail vehicle. The airbag module according to the present disclosure facilitates the free selection of the number of airbag modules based on the technical properties, in particular the vehicle width.

In one embodiment, the rail vehicle includes at least two of the airbag modules described herein. The rail vehicle defines a direction of travel. When viewed in the direction of travel, the two airbag modules are laterally adjacent and, with respect to a center line of the rail vehicle, arranged on different sides of the rail vehicle. This embodiment may be advantageous, in particular if the rails of the track do not project above the substrate, for example, if the rails are embedded in the substrate, or in the presence of closed spaces between rails.

In another embodiment, the rail vehicle includes at least three of the airbag modules described herein. A first airbag module is fixed on the rail vehicle in such a way that it is located between the rails, when viewed in the direction of travel. A second airbag module is fixed on the rail vehicle in such a way that it is located on the left side of the left rail, when viewed in the direction of travel. Furthermore, a third airbag module is fixed on the rail vehicle in such a way that it is located on the right side of the right rail, when viewed in the direction of travel. This embodiment is particularly advantageous in the presence of railway sleepers, where the substrate next to a rail may be lower than a rail upper edge. As the three airbag modules are located between or lateral to the rails, the three airbag modules may each contact the track, in particular, the airbag modules may contact the substrate, by which means a "slipping through", moving past, or moving farther toward structures located farther back is prevented for a person, who has been run over.

In another embodiment, the rail vehicle includes at least four of the airbag modules described herein. A first airbag module and a second airbag module are fixed on the rail vehicle in such a way that they are located between the rails, when viewed in the direction of travel. A third airbag module is fixed on the rail vehicle in such a way that it is located on the left side of the left rail, when viewed in the direction of travel. Furthermore, a fourth airbag module is fixed on the rail vehicle in such a way that it is located on the right side of the right rail, when viewed in the direction of travel. This embodiment is particularly advantageous in the presence of railway sleepers, where the substrate next to a rail may be lower than a rail upper edge. As the four airbag modules are located between or lateral to the rails, the four airbag modules may each contact the track, in particular, the airbag modules may contact the substrate, by which means a "slipping through", moving past, or moving farther toward structures located farther back is prevented for a person, who has been run over.

In addition to the number of airbag modules fixed on the rail vehicle, the respective position of the airbag module on the underside of the rail vehicle is also freely selectable. In particular, at least one of the airbag modules may be fixed offset to another airbag module, when viewed in the direction of travel. For example, in case of the presence of a coupling element arranged in the area of the front side of the rail vehicle, it may be advantageous to fix an airbag module, located for example, between the rails, offset toward the rear on the rail vehicle. Thus, the positions of the airbag modules may be variably adapted to the composition of the track and to the technical properties of the rail vehicle.

In addition to the number of airbag modules fixed on the rail vehicle and the respective position of the airbag module on the underside of the rail vehicle, the orientation of the airbag module with respect to the underside of the rail vehicle is also freely selectable. In particular, at least one of the airbag modules may be non-parallel to one of the other airbag modules. For example, it may be advantageous that an airbag module arranged next to a rail has a different orientation with respect to the underside of the rail vehicle than an airbag module located between the rails.

In summary, on the one hand, the length of the airbag module and/or the width of the airbag module may be freely selected; on the other hand, the number of airbag modules, and/or the orientation of the airbag module with respect to the underside of the rail vehicle, and/or the position of the airbag module at the underside of the rail vehicle may be freely determined. Due to the modularity of the solution according to the invention, the potential for a non-rectilinear arrangement of the airbag modules on the underside of the rail vehicle is facilitated. A plurality of airbag modules may be arranged on the underside of the rail vehicle along a convex or concave curve, by means of which dangerous areas of the rail vehicle may be covered, and the front ends of the airbag modules may be arranged in preferred, freely predetermined areas.

According to one embodiment, the rail vehicle has an obstacle position detection system, which is configured to detect an obstacle and to detect a position of the obstacle. The rail vehicle according to the present disclosure may, in the case that a plurality of airbag modules are present, be configured to selectively transfer or convert one or more of the airbag modules into the open state based on the position of the obstacle communicated by the obstacle position detection system. The obstacle position detection system, in conjunction with a selective triggering of the airbag modules, may advantageously reduce the expense for repairs and/or replacements, as potentially not all of the airbag modules fixed on the rail vehicle are transferred or converted into the open state. The airbag modules not transferred or converted into the open state remain functional and do not have to be repaired and/or replaced.

BRIEF DESCRIPTION OF THE DRAWINGS

The invention will subsequently be described in greater detail by way of embodiments, without these limiting the scope of protection defined by the claims.

The appended drawings illustrate embodiments and function together with the description to explain the principles of the invention. The elements of the drawings are relative to each other and not necessarily to scale. Identical references numerals correspondingly relate to similar parts.

DETAILED DESCRIPTION OF THE INVENTION

Figure 1:
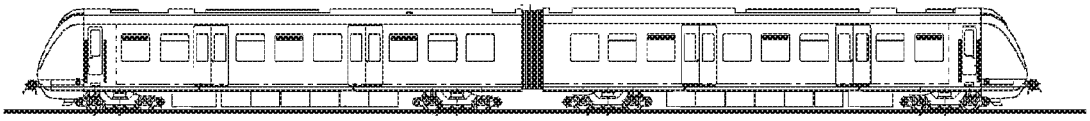
FIG. 1 shows a side view of a rail vehicle according to one embodiment.

FIG. 1 shows—in schematic depiction—a side view of a rail vehicle 100. The rail vehicle comprises an underside, wherein a direction of travel is defined in the operation of the rail vehicle.

Figure 2A:
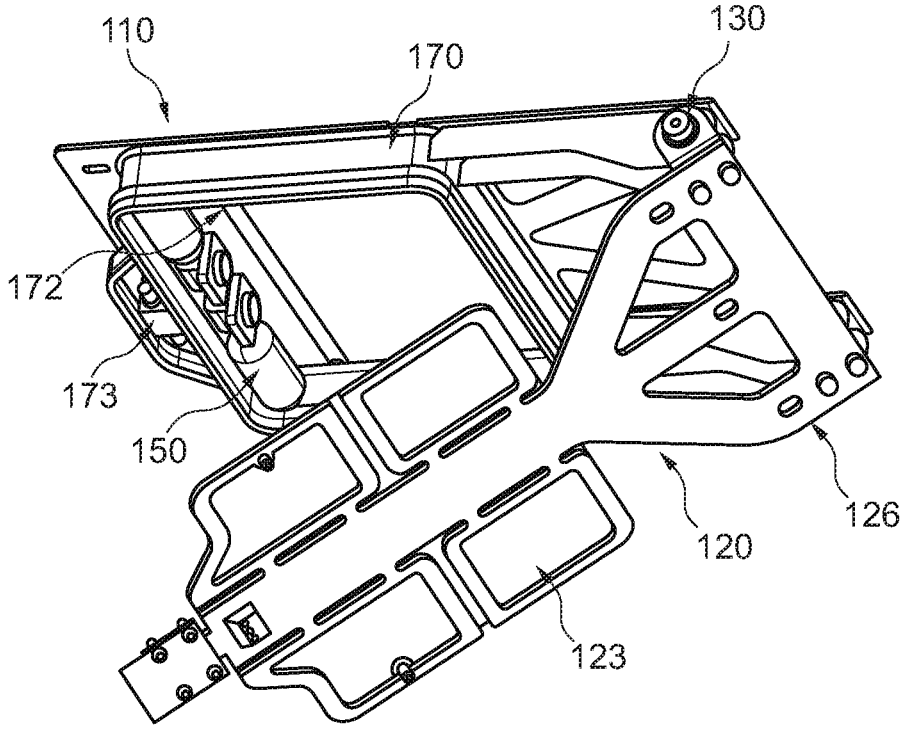
FIGS. 2A and 2B illustrate a side view of a part of the airbag module according to one embodiment.
Figure 2B:
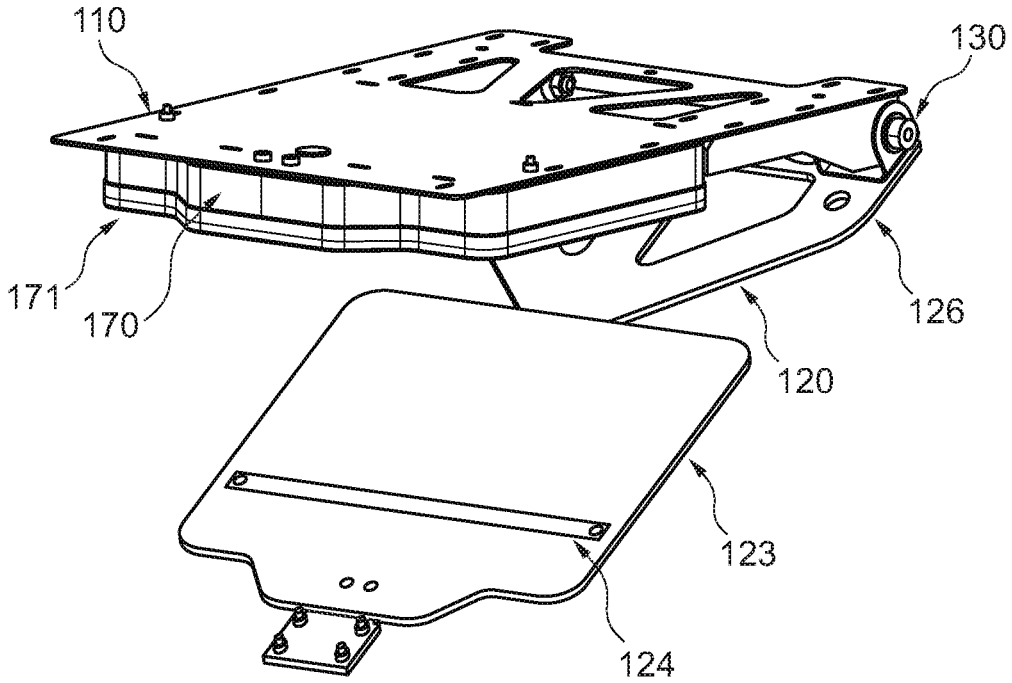

FIGS. 2A and 2B illustrate a side view of a part of an airbag module 110 according to one embodiment. The airbag module 110 is configured to be fixed on the underside of the rail vehicle 100, between rail vehicle 100 and track 200.

The airbag module 110 includes a bracket 170 for fixing airbag module 110 on the underside of the rail vehicle. Furthermore, the airbag module 110 includes a support flap 120 with a front end and a rear end. The support flap may be pivotably mounted at the rear end by means of a pivot bearing 130. For example, the airbag module 110 may include two pivot bearings 130. The support flap 120 may thereby be pivotably mounted at its rear end on the bracket 170 by means of the pivot bearing 130.

Figure 3A:
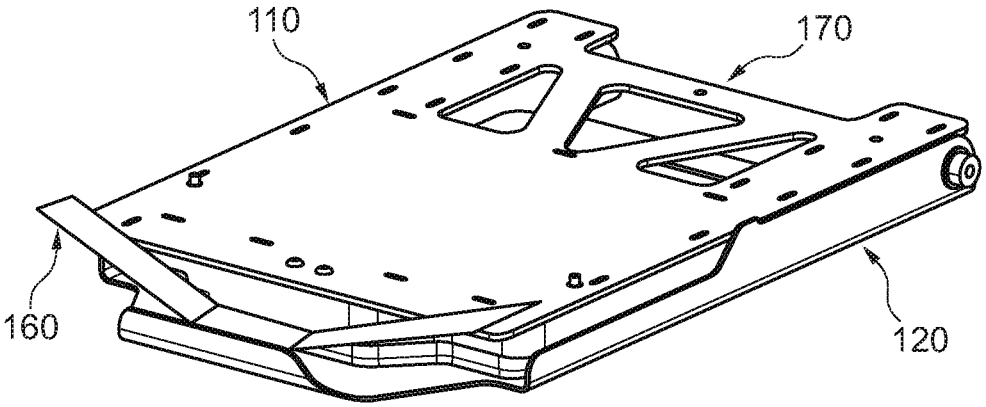
FIG. 3A shows the airbag module in the closed state according to one embodiment.
Figure 3B:
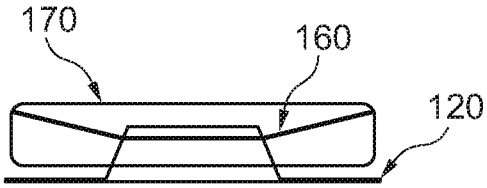
FIGS. 3B, 3C, 3D, and 3E illustrate the spring device of the airbag module according to one embodiment.
Figure 3C:
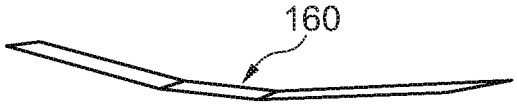
Figure 4A:
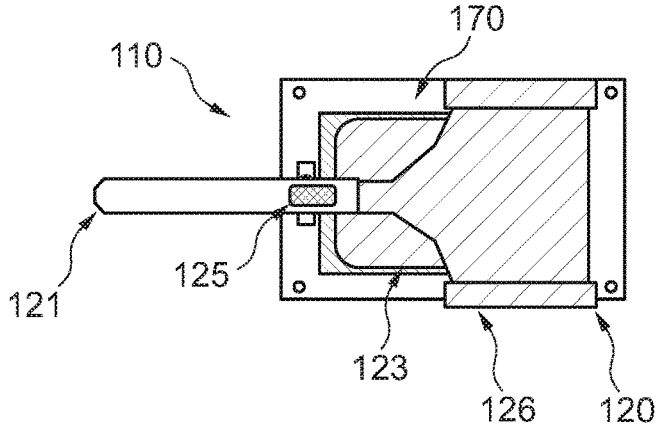
FIG. 4A shows a view of the airbag module from below according to one embodiment.
Figure 5:
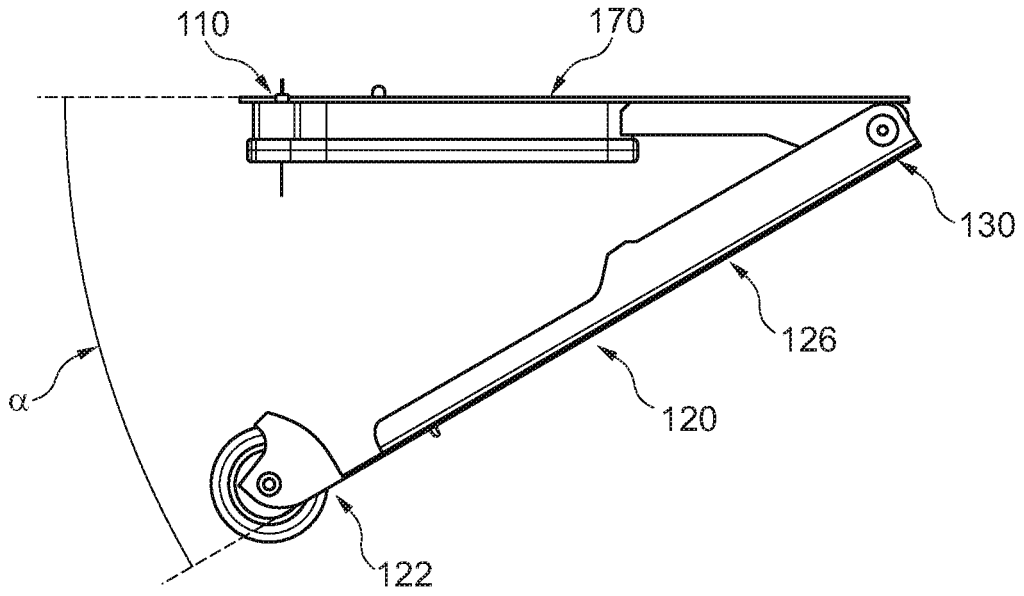
FIG. 5 shows a side view of a part of the airbag module in the open state according to one embodiment.

The airbag module includes a closed state, as shown for example in FIG. 3A or FIG. 4A, and an open state, as shown for example in FIG. 2, 5, or 6. By pivoting the support flap 120, the airbag module 110 may be converted from a closed state into an open state. By pivoting the support flap 120, the front end of the support flap 120 may move toward track 200.

Furthermore, the airbag module includes an airbag 140. The airbag 140 is not depicted in FIG. 2 to avoid cluttering the figure. For example, FIGS. 4C, 6A, and 6B each show embodiments of the airbag 140. The airbag 140 is fixed on the airbag module 110. In particular, the airbag 140 may be fixed on the support flap 120 and/or on the bracket 170. The bracket 170 of the airbag module 110 may include a first attachment 172, as depicted for example in FIG. 2A. The airbag 140 may be fixed on the bracket 170 by means of the first attachment 172. The support flap 120 of the airbag module 110 may include a second attachment 124, as depicted for example in FIG. 2B. The airbag 140 may be fixed on the support flap 120 by means of the second attachment 124.

Figure 4B:
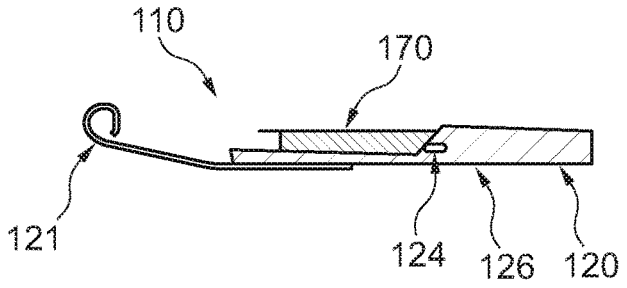
FIG. 4B shows a side view of the airbag module in the closed state according to one embodiment.
Figure 4C:
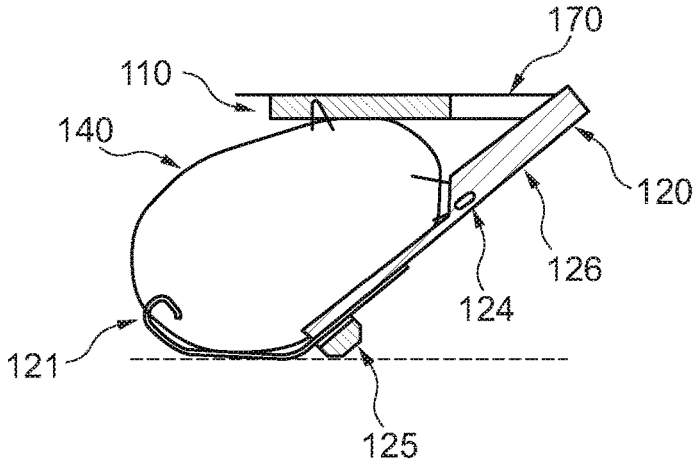
FIG. 4C shows a side view of the airbag module in the open state according to one embodiment.
Figure 4D:
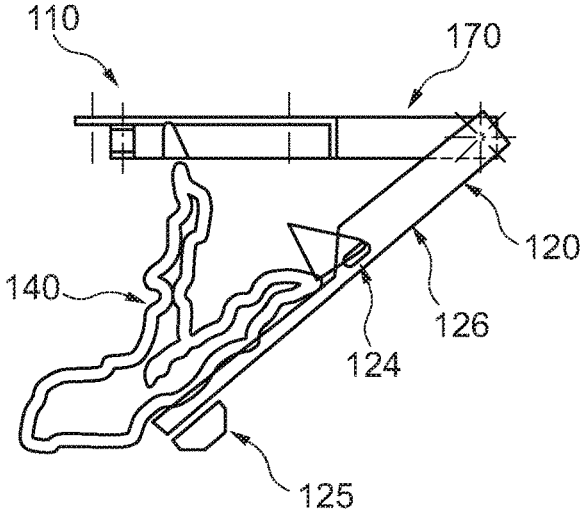
FIG. 4D shows a side view of the airbag module in the open state according to one embodiment.

In the closed state of the airbag module 110, the airbag 140 may be folded (not shown). In the open state of the airbag module 110, the airbag 140 may be unfolded. For example, the airbag 140 is filled in the open state of the airbag module 110. This is depicted by way of example in FIG. 4C or 6B. The airbag 140 may also not be filled in the open state of airbag module 110, but instead be partially or completely flaccid. The airbag 140 may be partially or completely flaccid, in particular due to damage to the airbag 140 caused by a sharp object on the track. FIG. 4D illustrates a partially or completely flaccid airbag 140.

In its unfolded state, the airbag 140 may project beyond the front end of the support flap 120, so that the unfolded airbag 140 and the support flap 120 together form an impact protection for a person on the track 200.

In one embodiment, the airbag 140 includes an outer shell. The outer shell may be produced from a plastic material. The outer shell functions to protect the airbag 140 from damage due to obstacles, in particular due to friction with obstacles 300. The outer shell may partially or completely enclose the airbag 140.

According to one embodiment, the bracket 170 may include a storage unit 171 open toward support flap 120, which is not limited to the embodiment depicted in FIG. 2B. In the closed state of the airbag module 110, the storage unit 171 may be closed by the support flap 120 and form a receptacle. The airbag 140 may be inserted into the receptacle. The receptacle functions for protecting the folded airbag 140 from environmental factors in the closed state of the airbag module 110. Furthermore, the storage unit 171 may include a seal. The seal functions to increase the protection of the folded airbag. The storage unit 171 may be a section of bracket 170, and thus form an integral unit; the storage unit 171 may also be a separate feature, wherein in this case, the storage unit 171 is fixed on the bracket 170, for example, is screwed to the bracket.

According to one embodiment, the support flap 120 may include a frame 126, at the rear end of which the pivot bearing 130 is arranged. The support flap 120 may include a cover plate 123, which may be supported by the frame 126. Embodiments of the frame 126 and the cover plate 123 are shown, for example, in FIGS. 2A and 2B. The cover plate 123 advantageously functions for protecting the folded airbag 140 from environmental factors in the closed state of the airbag module 110. Alternatively, the support flap 120 may also include a compound structure made from cover plates. The cover plate 123 may be a section of the support flap 120 and thus form an integral unit; the cover plate 123 may also be a separate feature, wherein in this case, the cover plate 123 is fixed on the support flap 120, for example, is screwed to the support flap 120. The cover plate 123 may be produced from a lightweight material, for example, from a plastic material or from a composite material.

In one embodiment, the airbag module 110 includes a gas pressure device 150 for sudden filling of the airbag during opening of the airbag module. The gas pressure device 150 may be connected to the bracket 170. The gas pressure device 150 may include at least one gas cylinder. FIG. 2A illustrates a part of the gas pressure device 150, wherein the embodiment of the gas pressure device 150 depicted in FIG. 2A includes two gas cylinders. Furthermore, the gas pressure device 150 may include at least one pressure reducer which may be connected to the gas cylinder. The pressure reducer may additionally be connected to the airbag 140. The gas pressure device 150 may include at least one valve, wherein the valve may be arranged between the gas cylinder and the pressure reducer or between the pressure reducer and the airbag. In the closed state of the airbag module 110, the valve may be closed. Upon opening the airbag module 110, the valve may be opened, by which means the airbag 140 may be suddenly filled. Alternatively, the gas cylinder may include a valve, which may be closed in the closed state of the airbag module 110, while during opening of the airbag module 110, the valve may be opened, by which means the airbag 140 may be suddenly filled.

According to one embodiment, the support flap 120 is essentially parallel to bracket 170 in the closed state of the airbag module 110 and/or the support flap 120 has an opening angle α from 30° to 80° with the bracket 170 in the open state of the airbag module 110. The opening angle α is illustrated in FIG. 5.

According to another embodiment, the airbag module 110 has a height of at most 80 mm in its closed state. A length and a width of the airbag module 110 may be flexibly determined based on the technical properties of the rail vehicle 100 or the composition of the track 200.

The airbag module 110 includes a guide element 121, 122 arranged on the front end of the support flap 120. The front end of the support flap 120 may contact the track 200 in the open state of the airbag module 110. The guide element 121, 122 may be designed as elastic in the vertical direction. The guide element 121, 122 is not depicted in FIG. 2 to avoid cluttering the figure. FIGS. 4B, 4C, and 5 illustrate embodiments of the guide element 121, 122.

According to another embodiment, the support flap 120 may include a foot 125, which may contact the track 200 in the open state of the airbag module 110. FIGS. 4C and 4D illustrate embodiments of the foot 125.

In one embodiment, the guide element 121, 122 is a sliding ski 121. The sliding ski 121 may thereby in particular include a front end, which is curved or angled upwards. The front-most tip is, for example, curved or angled upwards. The sliding ski 121 is suited for guiding the support flap 120 and the airbag 140 over a potential obstacle 300. The sliding ski 121 is illustrated by way of example in FIG. 4B. The sliding ski 121 may have a low thickness and be elongated. The sliding ski 121 is configured, for example, to elastically deform upon contact with an obstacle.

In another embodiment, the guide element 121, 122 is a wheel 122, wherein the wheel 122 is suited for rolling on the track 200 and may function to guide the support flap 120 and the airbag 140 over a potential obstacle. The wheel 122 is illustrated by way of example in FIG. 5.

Figure 10:
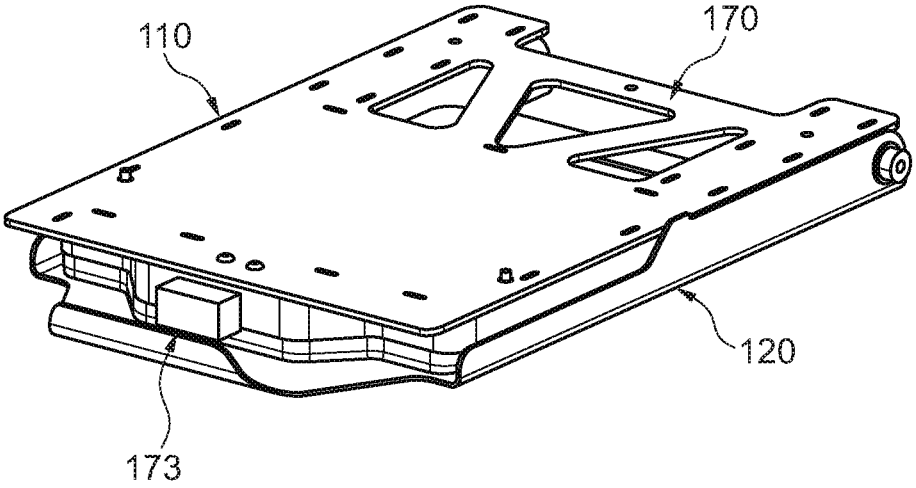
FIG. 10 illustrates a part of the airbag module according to one embodiment.

According to one embodiment, the support flap 120 is fixed in the area of its front end via a releasable locking means 173 in the closed state of the airbag module 110. One embodiment of the locking means 173 is depicted in FIG. 10. The locking means 173 may be releasable for releasing the support flap 120 and for converting the airbag module 110 into the open state. According to one embodiment, the locking means 173 may be configured to trigger the sudden filling of the airbag 140 by the gas pressure device 150. According to one embodiment, the locking means 173 may be configured to open the at least one valve of the gas pressure device 150. The releasable locking means 173 may comprise an element that is fixed on the bracket 170 and which fixes the support flap 120 in the closed state. Furthermore, the locking means 173 may include a quick lock release mechanism, which may quickly release a mechanical connection between the bracket 170 and the support flap 120, wherein the support flap 120 may be released. In one embodiment, the locking means 173 may include an electromagnetic magnetic locking means, wherein an electromagnet may be fixed on the bracket 170 and a passive magnet on the support flap 120. In another embodiment, the locking means 173 may include a cutting device, wherein the cutting device may include a mechanical connection between the bracket 170 and the support flap 120 and a cutting element, wherein the cutting element may be quickly moved towards the mechanical connection, wherein the mechanical connection may be severed. In another embodiment, the locking means 173 may include an electromechanical locking means, wherein the support flap 120 may include a hook and the bracket 170 may have an electromechanically movable latch.

When the support flap 120 has been released by the locking means 173, the support flap 120 may be converted into the open state due to its own dead weight. Advantageously, the airbag module 110 may additionally include a spring device 160. The spring device 160 may be tensioned when the support flap 120 is fixed, wherein, upon release of the support flap 120 by the locking means 173, the spring device 160 may suddenly pivot the support flap 120 to open the airbag module 110.

Figure 3D:
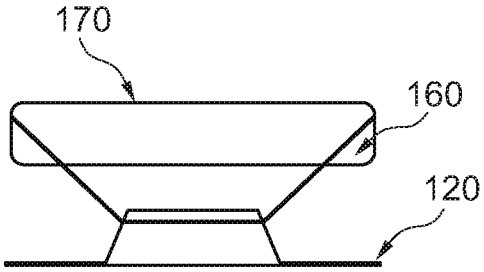
Figure 3E:
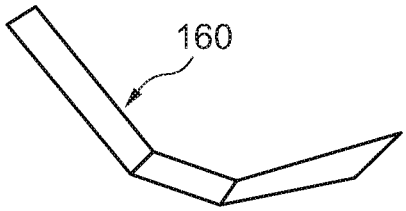

Embodiments of the spring device 160 are schematically depicted in FIGS. 3A to 3E. The spring device 160 may be fixed on the front end of the support flap 120 (as, e.g., depicted in FIG. 3A), in particular by welding the spring device 160 to the support flap 120. The spring device 160 may, in particular when the spring device 160 is not tensioned or is not elastically deformed, includes a U-shape (as, e.g., is depicted in FIGS. 3D and 3E). The spring device 160 may be elastically deformable. In particular, the spring device 160 may be elastically deformed when the airbag module 110 is in the closed state (as, e.g., is depicted in figured 3B and 3C). Due to the presence of the spring device 160, the time duration required to convert from the closed state into the open state may advantageously be substantially reduced. The spring device 160 is depicted in FIG. 3A merely for illustration purposes, in such a way that it does not project into the bracket, and is not to be understood as limiting for the arrangement of the spring device 160 in the airbag module 110.

FIGS. 4C and 4D show side views of the airbag module 110 in the open state according to one embodiment. In this case, FIG. 4C shows the filled airbag 140, while FIG. 4D shows the partially or completely flaccid airbag 140. By fixing the airbag 140 on the bracket 170 and on the support flap 120, the airbag 140 may not "slip out" of a collision area with a person. This is the case both for the filled and also for the partially or completely flaccid airbag 140. Furthermore, it may be gathered from FIGS. 4C and 4D that the airbag 140 is fixed on the bracket 170 and the support flap 120 in such a way that the attachment is substantially removed from a possible collision zone with a person. The airbag 140 may extend so far in the direction of the track 200, for example, that the airbag 140 contacts the track 200 in order to form a largest possible protection area for a person on the track.

As is likewise illustrated in FIGS. 4C and 4D, an attachment of the airbag 140 at the support flap 120 and at the bracket 170, results in a support of the airbag 140 toward a rear end of the airbag module 110, for example, along a direction of travel of the rail vehicle 100. By this means, a "slipping through" of a person, who has been run over, is advantageously prevented in the open state of the airbag module 110, wherein the airbag 140 is unfolded.

Figure 6A:
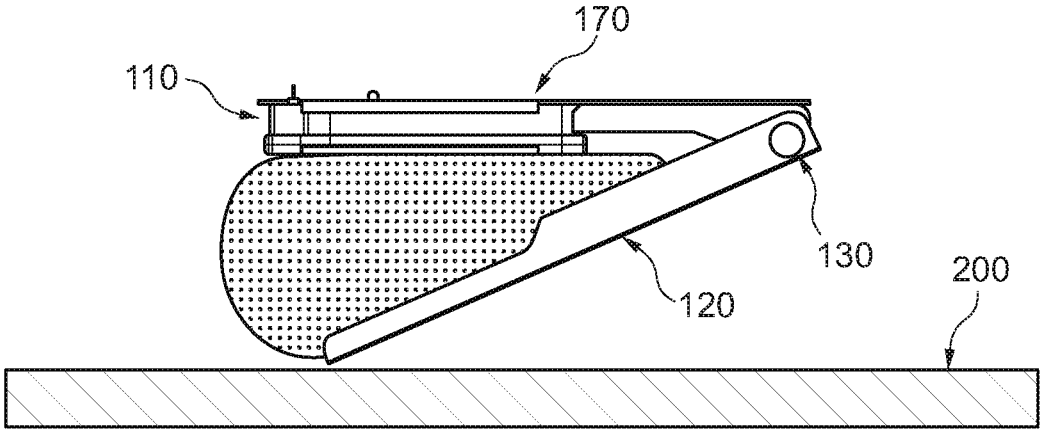
FIGS. 6A and 6B show a side view of the airbag module in the open state according to one embodiment.
Figure 6B:
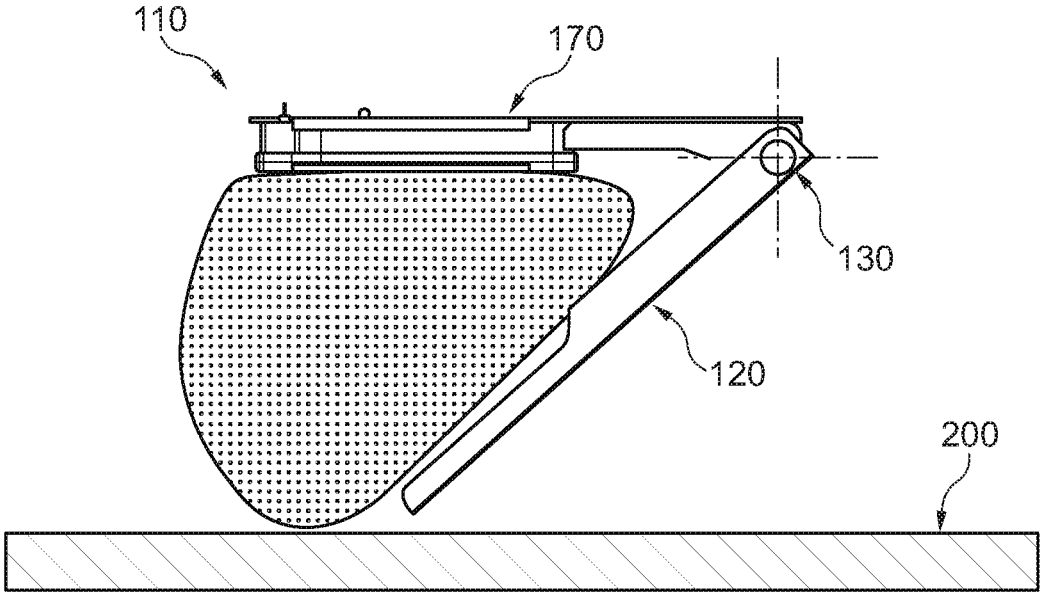

FIGS. 6A and 6B show a side view of the airbag module 110 in the open state according to one embodiment. FIG. 6A thereby shows the airbag module 110 with a small distance between the underside of the rail vehicle 100 and the track 200, while FIG. 6B shows the airbag module 110 with a larger distance between the underside of the rail vehicle 100 and the track 200. For reasons of overview, only a few of the features of the airbag module 110 are shown. In particular, the foot 125 or the guide element 121, 122 are not shown, wherein, for example, one of the two features contacts the track. The airbag module 110 is configured to adapt the opening angle α between the bracket 170 and the support flap 120 at different distances between the underside of the rail vehicle 100 and the track 200. In other words, the airbag module is configured to adapt a height of the airbag module 110 in the open state.

As is illustrated in FIGS. 6A and 6B, the airbag 140 of the airbag module 110 unfolds sufficiently both at larger and also smaller distances between the underside of the rail vehicle 100 and the track 200. Furthermore, the airbag module 110 is configured to prevent a "slipping through" of a person, both at larger and also at smaller distances between the underside of the rail vehicle 100 and the track 200.

Figure 7A:
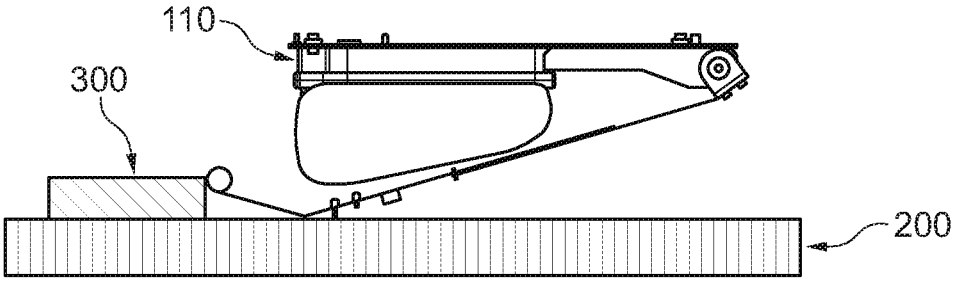
FIGS. 7A, 7B and 7C illustrate the operating principle of the airbag module according to one embodiment in the presence of an obstacle.
Figure 7B:
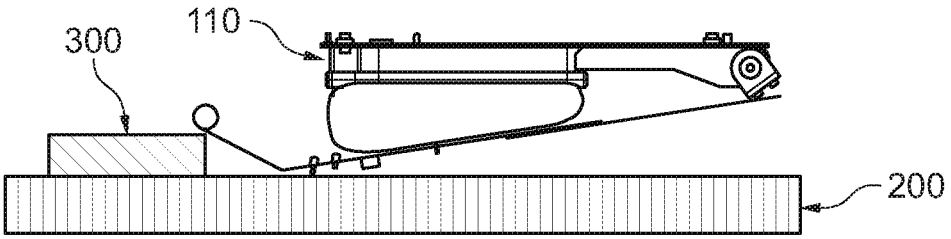
Figure 7C:
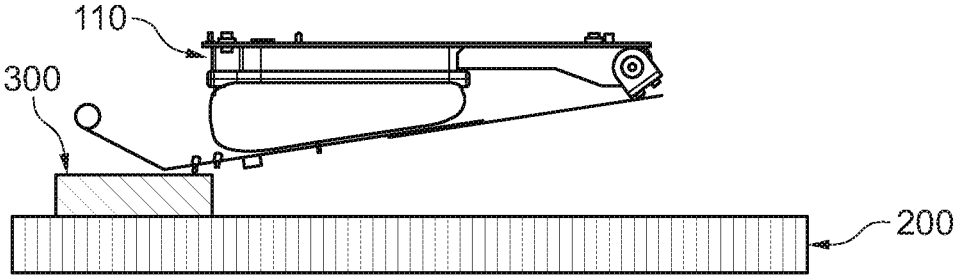

FIGS. 7A, 7B, and 7C illustrate the function of the airbag module 110 according to one embodiment in the presence of an obstacle 300 on the track 200, wherein the track 200 may itself have elevations and unevenness, and thus a part of the track 200 may simultaneously be the obstacle 300. For reasons of overview, only a few of the features of the airbag module 110 are shown. The guide element 121, 122, arranged on the front end of the support flap 120, functions to guide the support flap 120 and the airbag 140 over obstacles 300. By this means, the front end of the support flap 120 may be moved in the direction of the bracket 170, and thus the angle α between the bracket 170 and the support flap 120 is reduced. Without the provision of the guide element 121, 122, the front end of the support flap 120 might collide with a potential obstacle 300 and possibly be damaged.

According to one embodiment, a rail vehicle 100 is provided with an airbag module 110 according to one of the preceding embodiments, wherein the airbag module 110 is fixed on the underside of the rail vehicle 100 between the rail vehicle 100 and the track 200.

The rail vehicle 100 may include a plurality of airbag modules 110. Advantageously, each airbag module 110 may be fixed individually and independently from other airbag modules 110 on the rail vehicle 100.

Figure 8:
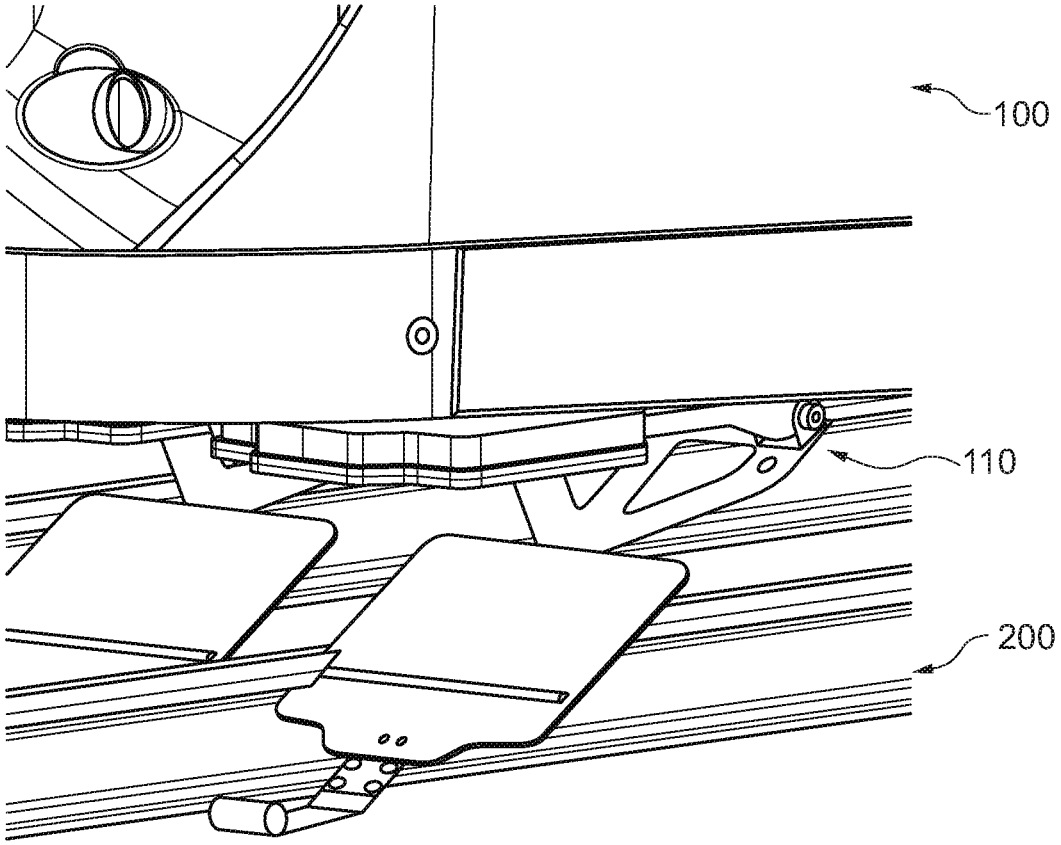
FIG. 8 shows a side view of a rail vehicle according to one embodiment.

FIG. 8 illustrates a rail vehicle 100 with a plurality of the airbag modules 110. The guide elements of the airbag modules 110 contact the substrate next to and between the rails in the open state of the airbag module 110 in this embodiment. The airbag 140 is not depicted in FIG. 8 for reasons of overview.

The airbag module 110 may be fixed directly on the underside of rail vehicle 100, for example, the airbag module 110 may be bolted to the underside of the rail vehicle 100. In another embodiment, a base plate is provided, which is fixed on the underside of the rail vehicle 100, for example, by screwing or welding. The airbag module 110 is thereby fixed on an underside of the base plate, for example, by screwing or welding. The base plate simplifies maintenance and/or an installation, conversion, or removal of the airbag module 110. In case of the presence of a plurality of airbag modules 110, one or a plurality of base plates may be provided. Each airbag module may thereby be respectively fixed to a base plate. Advantageously, a plurality of airbag modules may be fixed on one base plate, or all airbag modules may be fixed on one base plate.

Figure 9A:
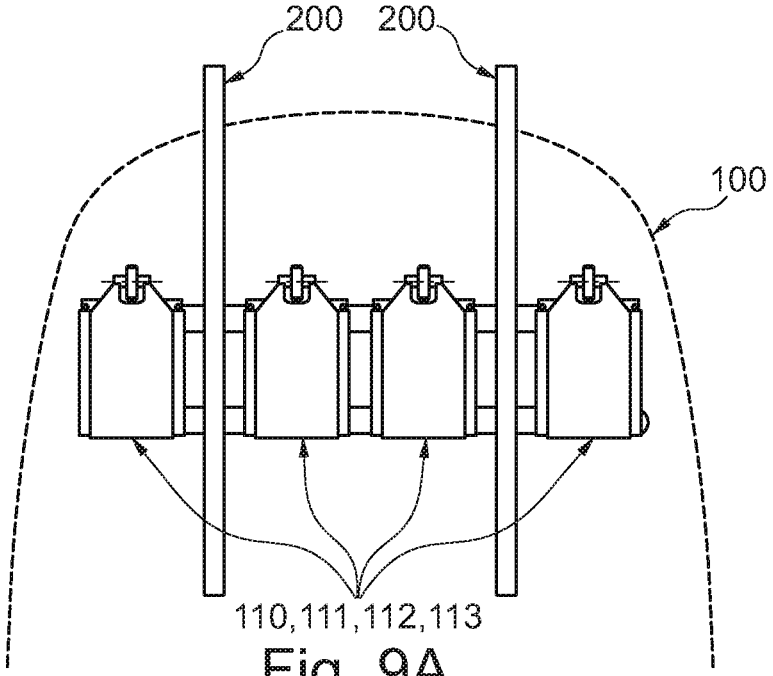
FIG. 9A shows a top view of a rail vehicle according to one embodiment having four airbag modules.
Figure 9B:
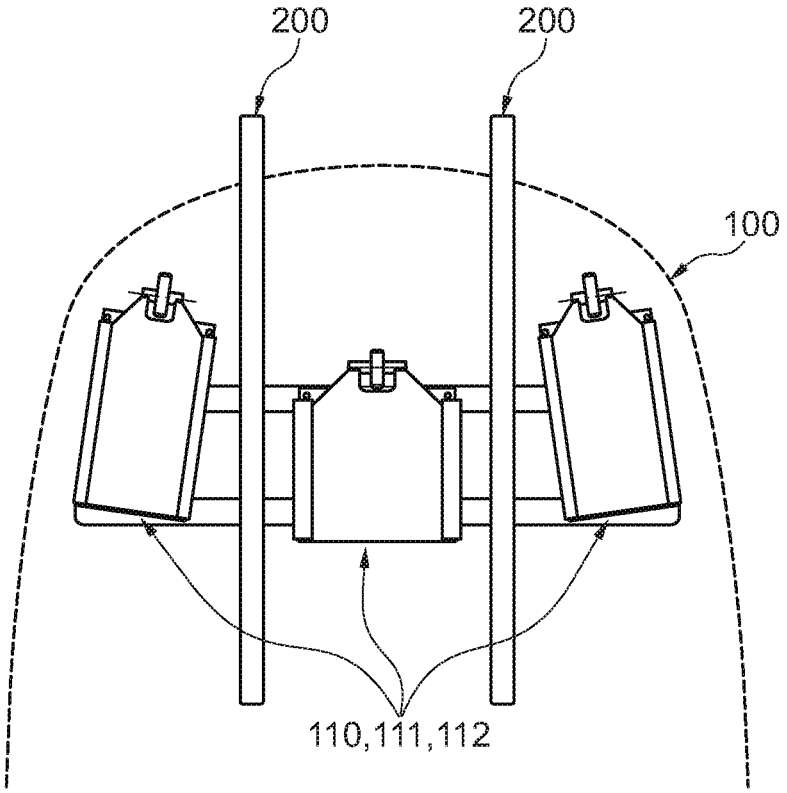
FIG. 9B shows a top view of a rail vehicle according to one embodiment having three airbag modules.
Figure 9C:
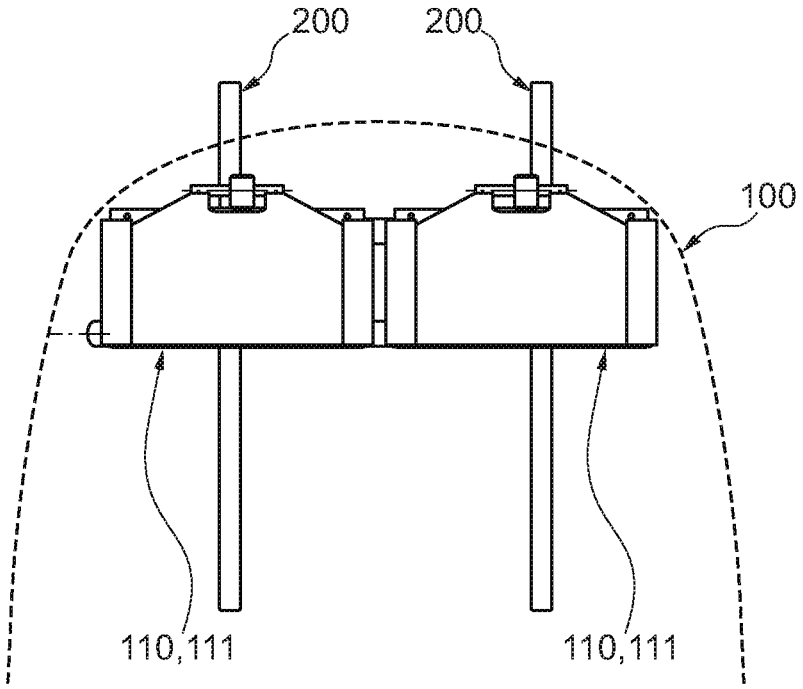
FIG. 9C shows a top view of a rail vehicle according to one embodiment having two airbag modules.

In one embodiment, rail vehicle 100 includes at least two airbag modules 110, 111, wherein airbag modules 110, 111 are each designed according to one of the preceding embodiments (see FIG. 9C). When viewed in the direction of travel, two airbag modules 110, 111 are laterally adjacent and, with respect to a center line of the rail vehicle, arranged on different sides of the rail vehicle. A first airbag module 110 may thereby be located at least partially on a left side of a left rail, and a second airbag module 111 may be located at least partially on a right side of a right rail.

In another embodiment, the rail vehicle 100 includes at least three airbag modules 110, 111, 112, wherein the airbag modules are each designed according to one of the preceding embodiments (see FIG. 9B). A first airbag module 110 is fixed on the rail vehicle 100 in such a way that it is located between the rails, when viewed in the direction of travel. A second airbag module 111 is fixed on the rail vehicle 100 in such a way that it is located on the left side of the left rail, when viewed in the direction of travel. Furthermore, a third airbag module 112 is fixed on the rail vehicle 100 in such a way that it is located on the right side of the right rail, when viewed in the direction of travel.

Furthermore, in another embodiment, the rail vehicle 100 includes at least four airbag modules 110, 111, 112, 113, wherein the airbag modules 110, 111, 112, 113 are each designed according to one of the preceding embodiments (see FIG. 9A). A first airbag module 110 and a second airbag module 111 are fixed on the rail vehicle 100 in such a way that they are located between the rails, when viewed in the direction of travel. A third airbag module 112 is fixed on the rail vehicle 100 in such a way that it is located on the left side of the left rail, when viewed in the direction of travel. Furthermore, a fourth airbag module 113 is fixed on the rail vehicle 100 in such a way that it is located on the right side of the right rail, when viewed in the direction of travel.

The respective position of the airbag module on the underside of the rail vehicle may be freely selected. For example, in FIG. 9B, the first airbag module 110 is arranged behind the airbag modules 111, 112.

Furthermore, the orientation of the airbag module to the underside of the rail vehicle is also freely selectable. For example, in FIG. 9B, all three airbag modules 110, 111, 112 are oriented differently with respect to the underside of the rail vehicle and are thus not arranged in parallel.

Even if specific embodiments are depicted and described herein, it remains within the scope of the present invention to suitably modify the embodiments shown without deviating from the scope of protection of the present invention.

The invention claimed is:

1. An airbag module for fixing on an underside of a rail vehicle between the rail vehicle and a track, the airbag module comprising:

a bracket for fixing the airbag module on the underside of the rail vehicle;

a support flap having a front end and a rear end, the support flap being pivotably mounted at the rear end by a pivot bearing, wherein the airbag module is convertible from a closed state into an open state by pivoting the support flap, with the front end of the support flap being movable toward the track;

a guide element arranged on the front end of the support flap and projecting past the front end of the support flap for contacting the track in the open state of the airbag module; and an airbag having a first end fixed on the support flap and a second end fixed on the bracket, the airbag being folded in the closed state of the airbag module and unfolded in the open state of the airbag module, wherein the airbag projects past the front end of the support flap in the unfolded state, so that the unfolded airbag and the support flap together form an impact protection for a person on the track, wherein the guide element is configured to guide the support flap and the airbag over obstacles on the track in presence of said obstacles.

2. The airbag module according to claim 1, wherein the guide element is a sliding ski for sliding on the track or a wheel for rolling on the track.

3. The airbag module according to claim 1, further comprising a gas pressure device for filling of the airbag during opening of the airbag module.

4. The airbag module according to claim 1, wherein, in the closed state of the airbag module, the support flap is fixed in an area of the front end via a releasable locking means, and wherein the locking means is releasable to release the support flap and to convert the airbag module into the open state.

5. The airbag module according to claim 1, further comprising a spring device, which is tensioned when the support flap is fixed, and with a release of the support flap, is configured to pivot the support flap to open the airbag module.

6. The airbag module according to claim 1, wherein the bracket comprises a storage unit open toward the support flap, which, in the closed state of the airbag module, is closed by the support flap, and which forms a receptacle into which the airbag is inserted.

7. The airbag module according to claim 1, wherein the support flap comprises a frame, on whose rear end the pivot bearing is mounted, and a cover plate which is supported by the frame.

8. The airbag module according to claim 1, wherein the support flap is essentially parallel to the bracket in the closed state of the airbag module and has an angle of 30° to 80° to the bracket in the open state of the airbag module.

9. The airbag module according to claim 1, wherein the airbag module has a height of at most 80 mm in the closed state.

10. A rail vehicle comprising an airbag module according to claim 1, wherein the airbag module is fixed on an underside of the rail vehicle between the rail vehicle and a track.

11. The rail vehicle according to claim 10, wherein the airbag module is fixed on the rail vehicle such that in the closed state, the airbag module does not project past the front end and/or the sides of the rail vehicle.

12. The rail vehicle according to claim 10, wherein the rail vehicle comprises at least two airbag modules each according to claim 1, wherein the rail vehicle defines a direction of travel, and wherein the two airbag modules are arranged laterally adjacent when viewed in the direction of travel and, with respect to a center line of the rail vehicle, are arranged on different sides of the rail vehicle.

13. The rail vehicle according to claim 10, wherein the rail vehicle comprises at least three airbag modules each according to claim 1, wherein a first airbag module is fixed on the rail vehicle such that the first airbag module is located between the rails, when viewed in a direction of travel, and wherein a second airbag module is fixed on the rail vehicle such that the second airbag module is located on the left side of the left rail, when viewed in the direction of travel, and wherein a third airbag module is fixed on the rail vehicle such that the third airbag module is located on the right side of the right rail, when viewed in the direction of travel.

14. The rail vehicle according to claim 13, wherein at least one of an orientation and a position of the airbag module on the underside of the rail vehicle is freely selectable such that at least one of the airbag modules is not parallel to one of the other airbag modules, and such that at least one of the airbag modules is fixed offset to another airbag module, when viewed in the direction of travel.

* * * * *